US008126583B2

(12) United States Patent
Roitto et al.

(10) Patent No.: US 8,126,583 B2
(45) Date of Patent: Feb. 28, 2012

(54) METHOD FOR SUPPLYING A CHEMICAL OR CHEMICAL COMPOUND IN A FIBROUS WEB MACHINE AND AN APPARATUS FOR IMPLEMENTING THE METHOD

(75) Inventors: Ilkka Roitto, Masku (FI); Tapio Nikola, Merimasku (FI); Alf Robertsson, Parainen (FI); Ari Murronmaa, Valkeakoski (FI); Petri Jokiranta, Naantali (FI); John Bergman, Ulm (DE)

(73) Assignee: Metso Paper, Inc., Helsinki (FI)

( * ) Notice: Subject to any disclaimer, the term of this patent is extended or adjusted under 35 U.S.C. 154(b) by 889 days.

(21) Appl. No.: 12/161,711

(22) PCT Filed: Dec. 29, 2006

(86) PCT No.: PCT/FI2006/050593

§ 371 (c)(1),
(2), (4) Date: Jul. 22, 2008

(87) PCT Pub. No.: WO2007/088238

PCT Pub. Date: Aug. 9, 2007

(65) Prior Publication Data

US 2009/0005897 A1 Jan. 1, 2009

(30) Foreign Application Priority Data

Feb. 1, 2006 (FI) ..... 20065073

(51) Int. Cl.

| | |
|---|---|
| ***G05D 7/00*** | (2006.01) |
| ***G05D 11/02*** | (2006.01) |
| ***D21F 1/06*** | (2006.01) |

(52) U.S. Cl. ..... 700/128; 700/282; 162/258

(58) Field of Classification Search ..... 700/122, 700/123, 127–129, 281–283; 162/1, 17, 162/61, 62, 109, 115, 252, 253, 258, 259, 162/262, 263

See application file for complete search history.

(56) References Cited

U.S. PATENT DOCUMENTS 4,940,035 A * 7/1990 Waring ..... 123/497

(Continued)

FOREIGN PATENT DOCUMENTS

DE 263121 A * 12/1988

(Continued)

OTHER PUBLICATIONS

English Translation of Office Action for JP2008550787.

(Continued)

*Primary Examiner* — M. N. Von Buhr

(74) *Attorney, Agent, or Firm* — Stiennon & Stiennon

(57) ABSTRACT

A chemical or chemical compound (L) is supplied via at least two displacement pumps (1, 4) to a common supply line (11), through which the chemical or chemical compound (L) is supplied to the operating device (12) of a fibrous web machine. Each pump (1, 4) has a corresponding electric actuator (2, 5) which is equipped with a corresponding control drive (3, 6). The fibrous web machine has a measuring device (8; 8*a*, 8*b*) for determining the phase angles of at least the first and second actuators (2,5). A control signal based on the determined phase angle information is formed and transmitted to the first control drive (3), based on the control signal, the difference between the first and second electric actuators (2, 5) is adjusted. An electric synchronization signal between the control drives (3, 6) maintains the difference between the phase angles electric actuators (2, 5).

17 Claims, 1 Drawing Sheet

U.S. PATENT DOCUMENTS

| | | | | |
|---|---|---|---|---|
| 5,150,612 | A * | 9/1992 | Lew | 73/253 |
| 5,674,051 | A * | 10/1997 | Maruyama | 417/3 |
| 5,775,879 | A * | 7/1998 | Durando | 417/45 |
| 6,305,917 | B1 * | 10/2001 | Franch | 417/461 |
| 6,511,305 | B1 * | 1/2003 | Franch | 417/481 |
| 6,736,937 | B2 | 5/2004 | Björkstedt et al. | |
| 2004/0219079 | A1 * | 11/2004 | Hagen et al. | 422/194 |
| 2005/0180870 | A1 | 8/2005 | Stanley et al. | |
| 2008/0232977 | A1 * | 9/2008 | Pan et al. | 417/44.11 |

FOREIGN PATENT DOCUMENTS

| | | | |
|---|---|---|---|
| DE | 19700633 | B4 | 6/2005 |
| EP | 0960980 | A1 | 12/1999 |
| FI | 981156 | | 11/1999 |
| JP | 61004572 | A | 1/1986 |
| JP | 61049179 | A * | 3/1986 |
| JP | 61058981 | A | 3/1986 |
| JP | 03134593 | A * | 6/1991 |
| JP | 3213685 | A | 9/1991 |
| JP | 07012040 | A * | 1/1995 |
| JP | 2000017599 | | 1/2000 |
| JP | 2003518208 | A | 6/2001 |
| JP | 2002138991 | A | 5/2002 |
| JP | 2005233019 | A * | 9/2005 |
| JP | 2005282517 | A * | 10/2005 |
| JP | 2005313104 | | 11/2005 |
| WO | 2007/088238 | A1 | 8/2007 |

OTHER PUBLICATIONS

Written Opinion of the International Searching Authority issued in PCT/FI2006/050593.

Search Report issued in PCT/FI2006/050593.

Supplementary European Search Report for PCT/FI2006050593 dated Nov. 3, 2011.

* cited by examiner

METHOD FOR SUPPLYING A CHEMICAL OR CHEMICAL COMPOUND IN A FIBROUS WEB MACHINE AND AN APPARATUS FOR IMPLEMENTING THE METHOD

CROSS REFERENCES TO RELATED APPLICATIONS

This application is a U.S. national stage application of International App. No. PCT/FI20006/050593, filed Dec. 29, 2006, the disclosure of which is incorporated by reference herein, and claims priority on Finnish App. No. 20065073, filed Feb. 1, 2006.

STATEMENT AS TO RIGHTS TO INVENTIONS MADE UNDER FEDERALLY SPONSORED RESEARCH AND DEVELOPMENT

Not applicable.

BACKGROUND OF THE INVENTION

The present invention relates to a method for supplying a chemical or chemical compound in a fibrous web machine, in which method the chemical or chemical compound is supplied via at least two displacement pumps to a common supply line, through which the chemical or chemical compound is supplied to the operating device of the fibrous web machine, and in which each displacement pump has a corresponding electric actuator.

In addition to this, the present invention also relates to an apparatus for supplying a chemical or chemical compound in a fibrous web machine, the apparatus comprising two displacement pumps, by means of which the chemical or chemical compound can be supplied to a common supply line, through which the chemical or chemical compound can be supplied to the operating device of the fibrous web machine, and in which each displacement pump has a corresponding electric actuator.

As a part of the fibrous web machine, for example in paper machines, may be a system which processes chemicals or chemical compounds or similar masses, that is connected through the supply system to the fibrous web processing machine proper. In the case of a coating machine, the supply system is the machine cycle which is connected, for example, to the paper coating machine, wherein the coating compound (a chemical compound) is applied with an applicator, for example a curtain coater (including, e.g. spray, blade and roller coating devices), on the surface of the paper. The coating compound is supplied to the coating machine, for example, by feeding it from a tank by means of one or more displacement pumps to the feed channel, which is in turn connected to the coater.

When a process fluid supplied through more than one pump to the same process connection is concerned, a problem arises from the pulsating pumping of the fluid by the displacement pumps. This creates pressure pulses in the process flow rate and fluctuation in the volume of flow. As an example could be mentioned that this results in unfavourable changes in the amount of coating compound supplied to the coating machine via two pumps, and further in the deterioration of the quality of the surface of the paper.

Another problematic area are changes in process conditions, for example, the changing of chemicals or power cuts, in connection with which the correct resynchronization of two or more pumps is rather difficult.

SUMMARY OF THE INVENTION

The aim of the present invention is to provide a method and apparatus by means of which the above disadvantages can be at least substantially reduced. The aim is to achieve a more constant flow output of process fluid in the process, where pressure cycles caused by displacement pumps do not cause substantial pressure variations in the common process, or irregularity in the flow rate. Another aim of the invention is to provide a method and apparatus that adapt rapidly and easily to changes in the process conditions.

To achieve the above, in the method according to the invention each electric actuator is equipped with a corresponding control drive, the fibrous web machine is equipped with a measuring device for determining the phase angles of at least the first and second electric actuators, a control signal based on the determined phase angle information is formed and transmitted to the first control drive, based on the control signal, the difference between the first and second electric actuators is adjusted so as to be as desired, and an electric synchronization signal is formed between the first and second control drives for maintaining the difference between the phase angles of the first and second electric actuators as desired.

Moreover, in order to achieve the aim stated above, the apparatus implementing the method according to the invention is arranged such that each electric actuator is equipped with a corresponding control drive, the fibrous web machine is equipped with a measuring device, by means of which can be determined the phase angles of at least the first and second actuators, data transmission means, by which a control signal based on the determined phase angle information can be transmitted to the first control drive, by means of which the difference in phase angles between the first and second electric actuators can be adjusted so as to be as desired, and that between the first and second control drives are arranged data transmission means for forming an electric synchronization signal for maintaining the difference between the phase angles of the first and second electric actuators as desired.

The invention is described in greater detail in the following, with reference to the accompanying drawings, in which:

DESCRIPTION OF THE PREFERRED EMBODIMENTS

Figure 1:
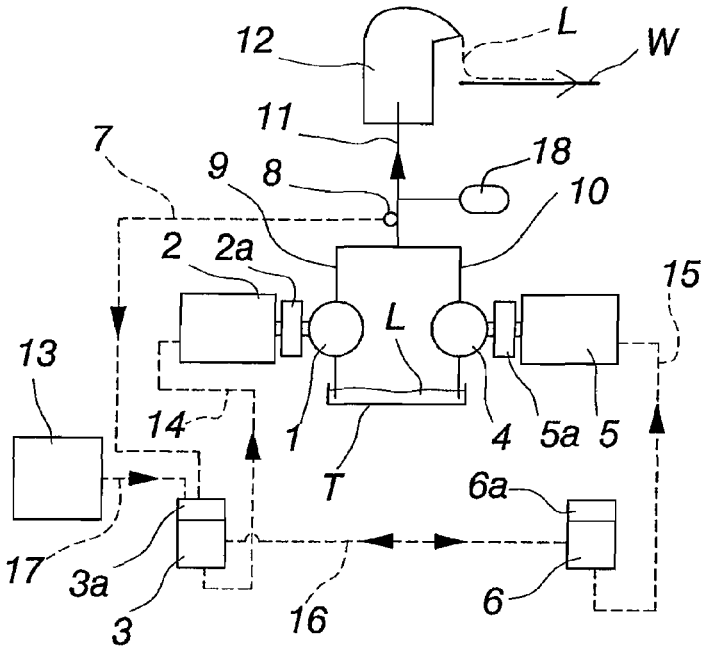
FIG. 1 shows diagrammatically an apparatus implementing a method according to one embodiment of the invention.

FIG. 1 shows diagrammatically one embodiment of an apparatus arrangement implementing the method according to the invention. The diagram mainly shows the features that are necessary for illustrating the inventive idea. FIG. 1 shows an arrangement where the coating compound L to be applied on the surface of the paper web W is fed to the coater marked by reference numeral 12.

This arrangement includes a tank T containing the coating compound L. The tank T is connected to two feeder lines or channels 9 and 10. Feeder line 9 is equipped with a corresponding displacement pump 1 and feeder line 10 is equipped with a corresponding displacement pump 4. After the pumps, feeder lines 9 and 10 join a common supply line 11, which is connected to the coater 12. Pumps 1 and 4 are thus connected in parallel. Alternatively, there may be more than two pumps, and thus also feeder lines, for example, three or four, which are joined in a common supply line 11. The displacement pumps are, for example, screw pumps or hose pumps.

Pump 1 is equipped with a corresponding electric actuator, for example, a speed-controlled motor drive and an inverter or servo. Pump 4 is correspondingly equipped with its own corresponding electric actuator 5.

In conjunction with the first electric actuator 2 is arranged a first control drive 3, which may be, for example, a frequency modifier or a servo drive for controlling the speed and the phase angle of the actuator 2. Correspondingly, a second control drive 6 is arranged in conjunction with a second electric actuator 5.

At a suitable point in the machine cycle is arranged a measuring device 8. In this case, the measuring device is a pressure sensor arranged in conjunction with the common supply line 11, the said sensor measuring the varying pressure pulses in the feeder line, which are caused by pumps 1 and 4 when feeding the coating composition L to the feeder line 11. Alternatively, the measuring device may be a vibration meter which measures the intensity of vibration in the feeder line 11 and other properties, such as the frequency and amplitude of the vibration, which are comparable to the phase angles of the first and second actuators. Furthermore, in an arrangement not shown in the figures, the measuring device 8 may consist of two sensors of the above-mentioned type, of which the first is arranged in conjunction with feeder line 9, on the suction or delivery side with respect to pump 1, and the second sensor is arranged in conjunction with feeder line 10, on the suction or delivery side with respect to pump 4.

A preferred method of equalizing pressure pulses is to turn the pump so that the suction side intake end of the pump is turned so as to become the delivery side output and vice versa. The direction of rotation of the screw is changed at the same time. The equalizing effect is due to the structure of the pump and the screw, wherein the changed direction of rotation of the pump equalizes the pulses and creates less air pockets.

In addition to this, equalization reservoirs (pressure accumulators) 18 may be connected to the hydraulic circuit in connection with pumps 1 and 4. The equalization reservoirs may be located, for example, in conjunction with the common supply line 11.

The measurement data is transmitted, preferably via electronic data transmission means 7, to the first control drive 3, especially its processor, or to a corresponding block 3*a*, where the control signal based on measurement data is formed for the first control drive 3. The processor 3*a* may determine the control signal, for example, based on the properties of the pressure data or vibration data. The processor may alternatively be a device separate from the control drive. The control signal may be transmitted to the control part 3 of the first control drive, whereby the difference between the phase angles of the first and second electric actuators 2 and 5 can be adjusted to be as desired. This is done, for example, by transmitting the control signal via the data transmission means 14 to the first electric actuator 2. As disclosed above, the difference between phase angles is adjusted especially so that variations (as also the volumetric flow) in the pressure of the process fluid in the machine cycle, particularly between the pumps and the operating device 12, can be equalized as well as possible. The best possible difference between phase angles is process-specific, and thus preferably also determined process-specifically.

In addition to this, between the first and second electric actuators 2 and 5 is formed an electric synchronization signal by means of data transmission means 16. By means of this synchronization signal, the phase angles of the first and second electric actuators 2 and 5 can be maintained as desired, that is, essentially constant after the above adjustment.

The actual speed instruction relating to phase angles comes from the process control system 13. From the control system 13 is transmitted an external control signal 17, for example, via the first control drive 3 to the second control drive 6 or directly to the second control drive 6. Based on this external control signal, transmitted for example via the data transmission means 15 to the second electric actuator 5, the angular speed of the second electric actuator 5 is thus adjusted to be as desired, in relation to which the differences between phase angles can be adjusted. In other words, in this case the second electric actuator 5 determines the speed required by the process condition with respect to which the first actuator 2 is adjusted to achieve the desired phase angle difference.

In addition to the speed instruction, the process control system 13 provides the first actuator 2 with both information on the need for the automatic shifting of the phase angle, and an external control signal for shifting the phase angle. The purpose of this is thus to change the difference in phase angles between actuator 2 and actuator 5. Such shifting of phase angles is necessary, for example, when changing one chemical compound to another, after stops due to power cuts or other reasons when the machine is restarted.

In addition, phase angle shifting is sometimes necessary due to the wear of machine parts, such as motors of pumps. The need for phase angle shifting for this reason is continuously monitored by the measuring device 8, which gives measurement data on the basis of which the phase angle is shifted, if necessary. In general, it may be said that by this arrangement is achieved the advantage that the difference between phase angles can be automatically adjusted to the level required by the respective process conditions. Process conditions typically change at 8-12 hour intervals, which means that by automatically adjusting the difference between phase angles, a more rapid change can be achieved than before to the process condition required. The process conditions may naturally change more or less often than mentioned above.

Figure 2:
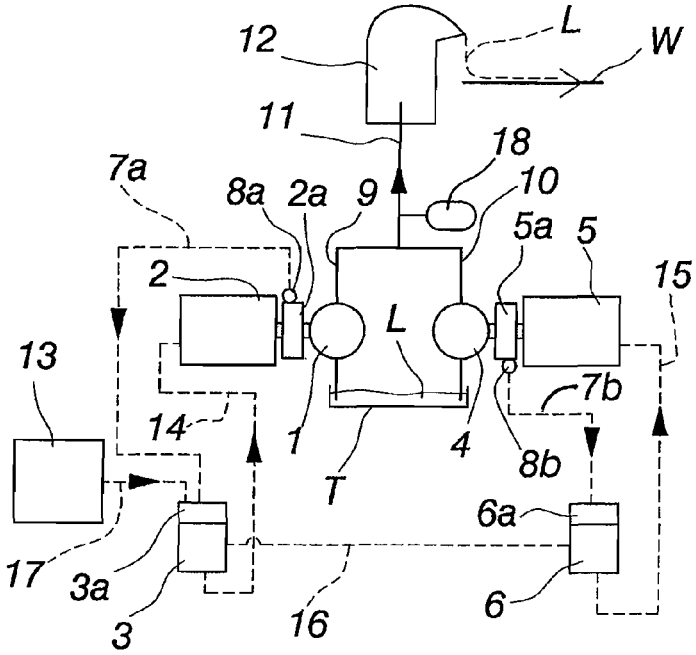
FIG. 2 shows diagrammatically an apparatus implementing a method according to another embodiment of the invention.

FIG. 2 shows another embodiment of the apparatus implementing the method, which may be implemented in addition to the first embodiment or instead of it. This embodiment differs from the first one in that instead of measuring vibration or pressure, an external location sensor 8*a* and 8*b* is used to determine so-called zero pulses of the electric drives 2 and 5. The zero pulse is a point in the electric drives 2 and 5 with respect to which can be determined the position of the electric drive (change in the angle of rotation) in each round it turns. The location sensors are located either between the pumps 1; 4 and the gearboxes 2*a*; 5*a* or between the motors 2; 5 and the gearboxes 2*a*; 5*a*. On the basis of the pulses, position data on both pumps is obtained at each start-up. The zero pulses of the pumps 1 and 4 can be transmitted to the control drives 3 and 6 via corresponding data transmission means 7*a* and 7*b*. On the basis of this data, the necessary phase angle shifting can be made by means of the control drives 3 and 6 to either of the electric actuators in order to equalize the pressure cycles produced by the pumps.

It has been found that the (electric) current collected by the actuators 2 and 5 or their torque correlates well with the data obtained from the measuring device 8 according to the first embodiment. Thus, it is conceivable that current or torque data obtained from the motor can be used to replace data obtained from the measuring device 8 according to the first embodiment.

According to a third embodiment can be determined the electric zero pulses of the control drives, wherein the mechanical positions of the pumps with respect to each other are not known, for example, following a cut in supply voltage or when mechanical parts of the pumps have been replaced by new ones. The determination may be carried out by means of an internal program or parameter of the control drives. In that case it is additionally required, for example, an arrangement according to the first embodiment to establish the correct phase angle and to adjust the differences between phase angles.

The present invention is not limited only to the embodiments described, but may also be applied to other parts of fibrous web machines, where process fluids or chemical compounds are handled. The invention may be used, for example, in the head box of a paper or board machine, where a constant process flow is required for a large amount of a chemical compound. One embodiment is an apparatus for producing glass fibres, in conjunction with which is arranged chemical and chemical compound feed for the fibre glass produced. The invention may be implemented in many ways within the scope of protection of the claims without limiting it to the embodiments and examples disclosed.

The invention claimed is:

1. A method for supplying a chemical or chemical compound in a fibrous web machine during the fiber web machine operation, comprising the steps of:

supplying to a common supply line the chemical or chemical compound via at least a first displacement pump having a first electric actuator and a first control drive, and a second displacement pump having a second electric actuator, and a second control drive;

further supplying the chemical or chemical compound from the common supply line to an operating device of the fibrous web machine;

wherein the first control drive is in controlling relation to the first electric actuator so as to control angular speed and phase angle of the first electric actuator;

wherein the second control drive is in controlling relation to the second electric actuator so as to control angular speed and phase angle of the second electric actuator;

measuring during the fiber web machine operation, a phase angle of the first electric actuator and a phase angle of the second electric actuator;

forming a control signal based on the measured phase angle of the first electric actuator and the phase angle of the second electric actuator and transmitting the control signal to the first control drive;

using the control signal during the fiber web machine operation, to control angular speed and phase angle of the first electric actuator to adjust a difference defined between the phase angles of the first electric actuator and the second electric actuator to a first selected value; and forming and transmitting an electric synchronization signal between the first control drive and the second control drive such that the first control drive and the second control drive can act on said synchronization signal to maintain the difference between the phase angles of the first electric actuator and the second electric actuator at the first selected value.

2. The method of claim 1 wherein the second electric actuator has an angular speed and further comprising the step of transmitting an external control signal to the second control drive of the second electric actuator and controlling the angular speed of the second electric actuator to a selected value based on the external control signal.

3. The method of claim 1 wherein the operating device is a paper coating unit and the chemical or chemical compound is a coating compound for coating paper, and further comprising coating a paper web with the coating compound.

4. The method of claim 1 wherein the chemical or chemical compound is an adhesive, a pigmented adhesive or a sizing agent, and further comprising coating a paper web with said adhesive, pigmented adhesive or sizing agent.

5. The method of claim 1 wherein the step of measuring the phase angles of at least the first electric actuator and the second electric actuator includes measuring pressure in the common supply line.

6. The method of claim 1 wherein the step of measuring the phase angles of at least the first electric actuator and the second electric actuator includes measuring vibration in the common supply line.

7. The method of claim 1 wherein the step of measuring the phase angles of at least the first electric actuator and the second electric actuator includes:

determining the position of the first electric actuator with respect to a first point in the first electric actuator with a first external position sensor mounted between the first pump and the first electric actuator;

determining the position of the second electric actuator with respect to a second point in the second electric actuator with a second external position sensor mounted between the second pump and the second electric actuator;

starting the first pump and the second pump and obtaining position data on the first pump, and obtaining position data on the second pump at startup;

transmitting to the first control drive the position data on the first pump, and transmitting to the second control drive the position data on the second pump; and using the first control drive, on the basis of the first pump position data, or the second control drive on the basis of the second pump position data, to shift the phase angle of either of the first electric actuator or the second electric actuator to equalize pressure cycles produced by the first displacement pump and the second displacement pump.

8. The method of claim 1 wherein the step of measuring the phase angles of at least the first electric actuator and the second electric actuator includes: determining an electric zero pulse of each of the first control drive and the second control drive.

9. An apparatus for supplying a chemical or chemical compound in a fibrous web machine comprising:

a first displacement pump;

a first electric actuator in driving relation to the first displacement pump, the first displacement pump connected in receiving relation to a supply of the chemical or chemical compound, and in supplying relation to a common supply line which is connected to an operating device of the fibrous web machine;

a second displacement pump;

a second electric actuator in driving relation to the second displacement pump, the second displacement pump connected in receiving relation to the supply of the chemical or chemical compound, and in supplying relation to the common supply line which is connected to the operating device of the fibrous web machine;

a first control drive in controlling relation to the first electric actuator;

a second control drive in controlling relation to the second electric actuator;

a measuring device arranged to measure during the fiber web machine operation a phase angle of at least the first actuator and the second actuator;

a processor, in phase angle receiving relation with respect to the measuring device, the processor arranged to produce a control signal based on said measured phase angles of at least the first actuator and the second actuator;

a first control device in control signal receiving relation to the processor and in transmitting relation to the first control drive such that a difference in phase angle between the first electric actuator and the second electric actuator can be adjusted during the fiber web machine operation to a selected value; and a data transmission link between the first control drive and the second control drive, the data transmission link arranged to transmit an electric synchronization signal between the first control drive and the second control drive for maintaining the difference between the first and second electric actuators at the selected value.

10. The method of claim 9 further comprising a process controller connected to transmit an external control signal to the first control device.

11. The method of claim 9 wherein the operating device is a coating unit and the chemical or chemical compound is a coating compound for coating paper.

12. The method of claim 9, wherein the measuring device is a pressure sensor or a vibration sensor which is located in the common supply line.

13. The method of claim 9, wherein the measuring device is a first location sensor positioned in conjunction with the first electric actuator for determining the position of the first electric drive in each round the first electric drive turns, and a second location sensor positioned in conjunction with the second electric actuator for determining the position of the second electric drive in each round the second electric drive turns.

14. A method of coating a paper web comprising the steps of:

supplying a coating from a tank containing coating with at least a first displacement pump driven by a first electric motor and controlled by a first control drive and a second displacement pump driven by a second electric motor controlled by a second control drive wherein the first displacement pump and the second displacement pump withdraw coating from the tank and supply the coating to a common supply line connected to a coater, so that coating from the tank is supplied to the coater, and further supplied to the paper web;

measuring a parameter from which can be determined a phase angle difference between the first pump and the second pump;

determining the phase angle difference between the first pump and the second pump from the parameter during the fiber web machine operation;

forming a control signal based on the phase angle difference during the fiber web machine operation and adjusting the phase angle difference during the fiber web machine operation to minimize variations in the pressure of the coating supplied to the coater through the common supply line, and transmitting the control signal to the first control drive; and maintaining the phase angle difference during the fiber web machine operation to minimize variations in the pressure of the coating supplied to the coater through the common supply line by forming an electric synchronization signal between the first control drive and the second control drive and using said synchronization signal to maintain the phase angle of the first displacement pump or the second displacement pump.

15. The method of claim 14 wherein the step of measuring a parameter is performed using a pressure sensor or a vibration sensor which is located in the common supply line.

16. The method of claim 14 wherein the step of measuring a parameter is performed using a first location sensor, positioned in conjunction with the first electric motor for determining an angular position of the first electric motor in each round the first electric motor turns, and a second location sensor positioned in conjunction with the second electric motor for determining an angular position of the second electric motor in each round the second electric motor turns.

17. The method of claim 14 wherein the step of measuring a parameter is performed using electric current collected by the first electric motor and the second electric motor.

* * * * *